US005704670A

United States Patent [19]

Surplus

[11] Patent Number: 5,704,670

[45] Date of Patent: Jan. 6, 1998

[54] GLOVE BAG

[76] Inventor: Donald Neil Surplus, 2347 Joanne Cir., Napa, Calif. 94559

[21] Appl. No.: 782,341

[22] Filed: Jan. 13, 1997

[51] Int. Cl.[6] ..... A01K 29/00; A41D 19/00

[52] U.S. Cl. ..... 294/25; 2/159; 294/1.3; 383/4

[58] Field of Search ..... 294/1.3, 25; 2/16, 2/20, 159, 161.7; 15/104.8, 227, 257.1; 119/161; 206/223, 496; 383/4, 42, 63, 70, 71, 77, 907

[56] References Cited

U.S. PATENT DOCUMENTS

| | | | |
|---|---|---|---|
| 4,645,251 | 2/1987 | Jacobs | 294/25 X |
| 4,677,697 | 7/1987 | Hayes | 294/25 X |
| 4,788,733 | 12/1988 | Lerner | 294/1.3 X |
| 4,845,781 | 7/1989 | Strickland et al. | 294/1.3 X |
| 4,937,881 | 7/1990 | Heise | 294/1.3 X |
| 5,186,322 | 2/1993 | Harreld et al. | 294/1.3 X |
| 5,568,955 | 10/1996 | Giuliano et al. | 294/25 X |

FOREIGN PATENT DOCUMENTS

| | | | |
|---|---|---|---|
| 2645188 | 10/1990 | France | 294/1.3 |

*Primary Examiner*—Johnny D. Cherry
*Attorney, Agent, or Firm*—Jack Lo

[57] ABSTRACT

A glove bag includes a glove portion, an enlarged cuff portion, and a sealing strip arranged on an open rear end of the cuff portion. To use, the bag is worn over a hand, and the hand is used to pick up an article. The glove portion provides complete freedom of movement for the fingers to handle the article with precision. The glove bag is everted over the article to contain it, and the open rear end is sealed with the sealing strip. The article is thus isolated in the glove bag without being contaminated by the hand, and without contaminating the hand. The cuff portion is large enough to hold a variety of articles.

6 Claims, 2 Drawing Sheets

GLOVE BAG

BACKGROUND OF THE INVENTION

1. Field of the Invention

This invention relates generally to bags, specifically to a glove bag.

2. Prior Art

Plastic bags are often used for protecting articles from contamination, or for preventing dirty or hazardous articles from contaminating the environment. For example, plastic bags are used for collecting crime scene evidence, and for containing and disposing waste matter or hazardous material. If the article is picked up and placed in the bag by hand, the article will be contaminated by the hand, or vice versa. Although gloves can be used, they must be carried and used separately. After they are used to pick up a dirty or hazardous article, they become a source of contamination and present an additional disposal problem. If a delicate article is picked up and placed in a bag with a tool, such as a pair of tongs, the tool may damage the article. The tool may also require cleaning or sterilization. Furthermore, when a wet article is inserted into the bag, it will usually touch the rim of the bag on the way in, so that the contamination may be spread by the wet rim even after the bag is tied, and cleanup may be necessary.

OBJECTS OF THE INVENTION

Accordingly, the primary object of the present invention is to provide a glove bag for picking up an article without requiring separate gloves or tools to minimize contamination and cleanup.

Another object of the present invention is to provide a glove bag that enables the user to handle the article with precision when picking it up.

Yet another object of the present invention is to provide a glove bag for containing and isolating the article after picking it up to protect it from contamination, or to prevent it from contaminating the user's hand or the environment.

Further objects of the present invention will become apparent from a consideration of the drawings and ensuing description.

BRIEF SUMMARY OF THE INVENTION

A glove bag includes a plastic glove with an enlarged cuff portion that serves as a bag. A closure or sealing means is arranged at the open end of the bag.

DRAWING REFERENCE NUMERALS

| | |
|---|---|
| 10. Glove Bag | 11. Glove Portion |
| 12. Cuff Portion | 13. Open End |
| 14. Sealing Means | 15. Sealing Means |
| 16. Sealing Means | 17. Foldable Flap |
| 18. Adhesive Strip | 19. Removable Protective Sheet |
| 20. Labels | 21. Article |
| 22. Forward End | |

DETAILED DESCRIPTION OF THE INVENTION

FIGS. 1–3

Figure 1:
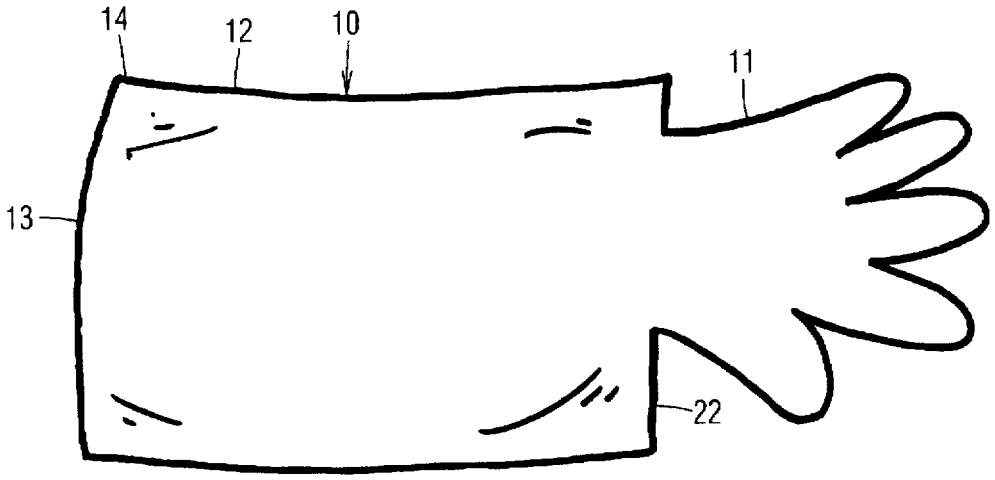
FIG. 1 is a side view of a glove bag in accordance with a first embodiment of the invention.
Figure 2:
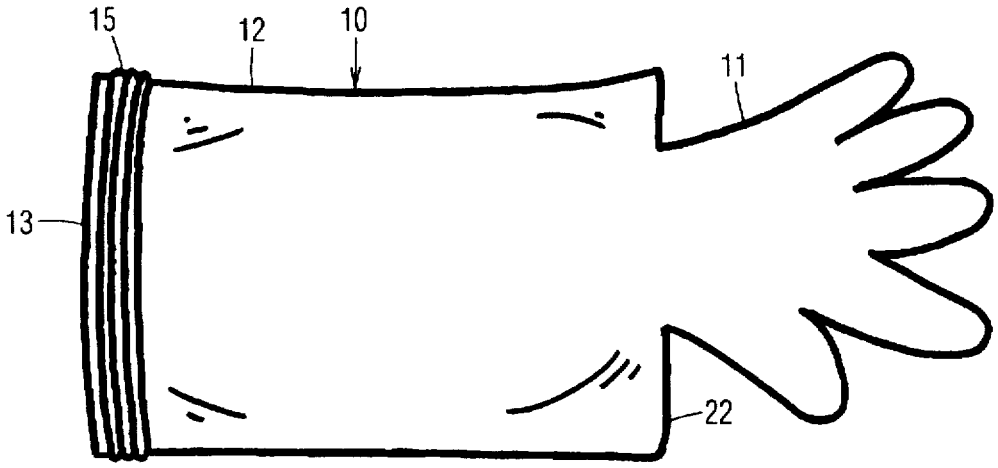
FIG. 2 is a side view of the glove bag in accordance with a second embodiment of the invention.
Figure 3:
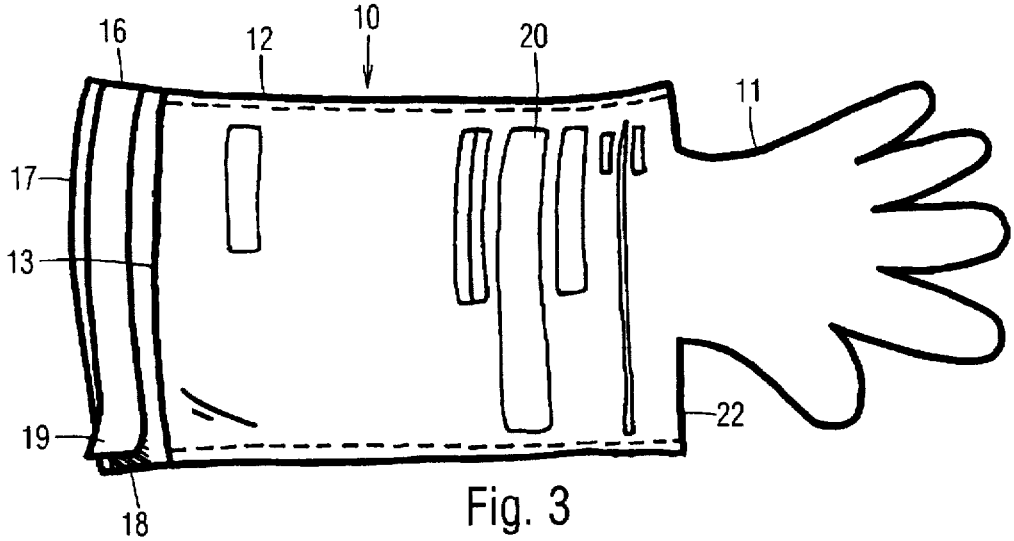
FIG. 3 is a side view of the glove bag in accordance with a third embodiment of the invention.

In accordance with a first embodiment of the invention shown in the side view of FIG. 1, a glove bag 10 includes a glove portion 11 with separate fingers, an enlarged cuff portion 12 with a forward end 22 integrally connected to glove portion 11, and an open rear end 13. A closure or sealing means 14 is arranged at open end 13. In this example, sealing means 14 comprises a section of cuff portion 12 which can be gathered and tied into a knot (not shown). FIG. 2 shows a second embodiment of the glove bag in which a sealing means 15 comprises a zipper of the type sold under the trademark "ZIPLOC" by DowBrands of Indianapolis, Ind. FIG. 3 shows a third embodiment of the glove bag in which a sealing means 16 comprises a foldable flap 17 with an adhesive strip 18 disposed on the outside thereof, and a removable protective sheet 19. Labels 20 arranged on cuff portion 12 provide surfaces for written notes. In all embodiments, glove bag 10 is preferably made of a flexible plastic film.

FIGS. 4–7

Figure 4:
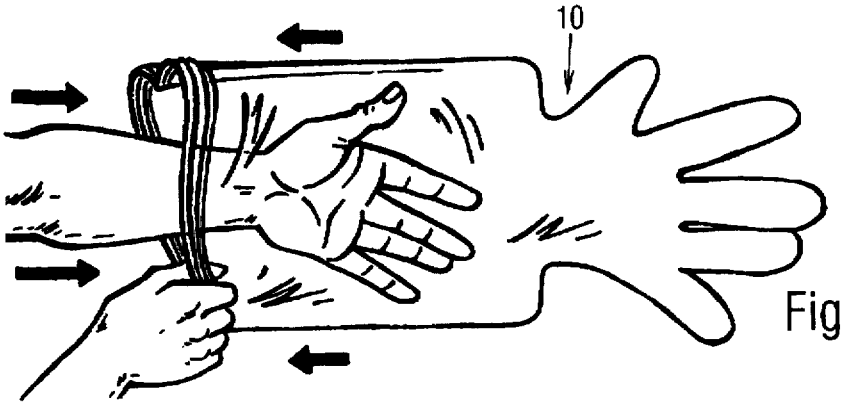
FIG. 4 is a side view of the glove bag being worn.
Figure 5:
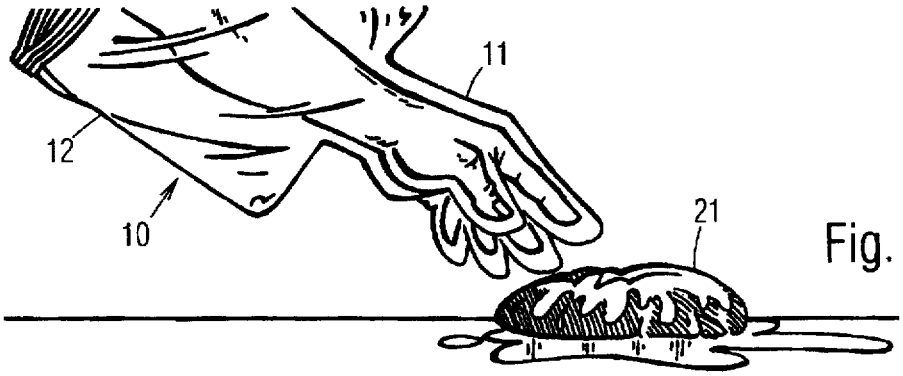
FIG. 5 is a side view of the glove bag being used to pick up an article.
Figure 6:
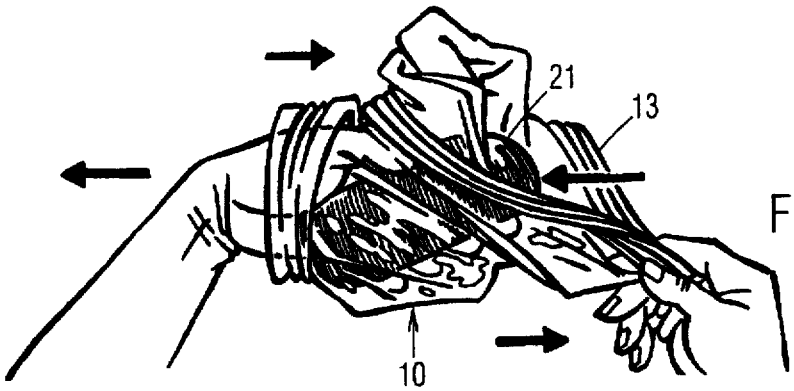
FIG. 6 is a side view of the glove bag being everted.
Figure 7:
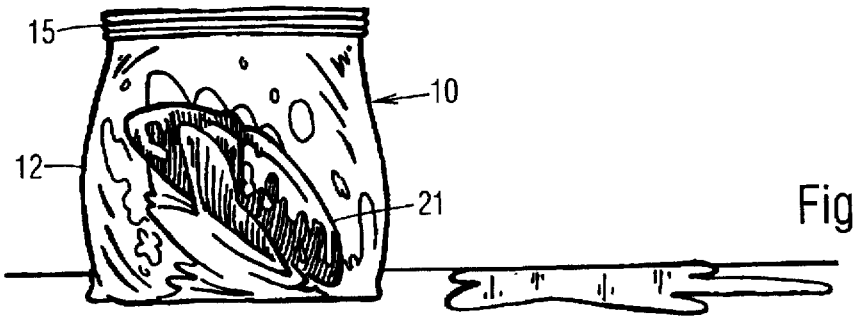
FIG. 7 is a side view of the glove bag after being sealed.

The use of the glove bag is illustrated with the second embodiment of FIG. 2. Glove bag 10 is everted and worn over a hand, as shown in FIG. 4. A desired article 21 is picked up by the gloved hand, as shown in FIG. 5. The hand is thus protected from being contaminated by article 21, and article 21 is protected from being contaminated by the hand. Glove portion 11 provides complete freedom of movement for the fingers, so that the user may handle article 21 with precision. Picking up article 21 by hand also avoids damaging it with tools, such as tongs. Glove bag 10 is everted again by holding article 21 with the gloved hand, and pulling open end 13 forwardly with the other hand, as shown in FIG. 6. Glove bag 10 is sealed by closing zipper or sealing means 15, as shown in FIG. 7. Article 21 is thus contained and isolated in cuff portion 12. The other embodiments of the glove bag shown in FIGS. 1 and 3 do not require to be everted prior to the insertion of the hand.

SUMMARY AND SCOPE

Accordingly, I have provided a glove bag that is usable for picking up an article with precision, without requiring separate gloves or tools to minimize contamination and cleanup. It also prevents the hand from contaminating the article, or prevents the article from contaminating the hand or the environment.

Although the above descriptions are specific, they should not be considered as limitations on the scope of the invention, but only as examples of the embodiments. Many substitutes and variations are possible within the teachings of the invention. For example, cuff portion 12 may be of other sizes and shapes for containing articles of any size. Glove portion 11 may be a mitten. Other sealing means may be used, such as a wire tie, hook-and-loop fasteners, etc.

Glove bag 10 may be made of other flexible materials, such as rubber, fabric, netting, transparent plastic film, etc. Therefore, the scope of the invention should be determined by the appended claims and their legal equivalents, not by the examples given.

I claim:

1. A glove bag, comprising:

a glove portion adapted to be worn over a hand, said glove portion including a wrist portion;

a rectangular cuff portion having a forward end connected to said wrist portion of said glove portion, and an open rear end, said cuff portion being at least as long as said glove portion, said forward end of said cuff portion being substantially wider than said wrist portion and extending generally orthogonally from opposite sides of said wrist portion, said cuff portion being adapted to be worn over a forearm; and sealing means arranged on said open rear end of said cuff portion, so that when said glove bag is worn over a hand, said glove bag is adapted for picking up an article with said glove portion, said glove bag is adapted to be everted over said article for containing said article within said cuff portion, and said open rear end of said glove bag is sealed with said sealing means for isolating said article.

2. The glove bag of claim 1, wherein said sealing means comprises a section of said cuff portion usable for being knotted.

3. The glove bag of claim 1, wherein said sealing means comprises a zipper.

4. The glove bag of claim 1, wherein said sealing means comprises an adhesive strip.

5. The glove bag of claim 1, wherein said glove portion has a predetermined width and a predetermined length, and said cuff portion is substantially wider than said glove portion.

6. The glove bag of claim 1, wherein said glove portion includes a plurality of separate fingers.

* * * * *